US005351750A

United States Patent [19]

Garcia

[11] Patent Number: 5,351,750

[45] Date of Patent: Oct. 4, 1994

[54] TUBULAR ELEMENT FOR A HEAT EXCHANGER

[75] Inventor: José J. Garcia, Jamestown, N.Y.

[73] Assignee: Valeo Engine Cooling, Inc., Jamestown, N.Y.

[21] Appl. No.: 36,323

[22] Filed: Mar. 24, 1993

[51] Int. Cl.[5] ..... F28F 19/02

[52] U.S. Cl. ..... 165/133; 165/134.1; 428/654

[58] Field of Search ..... 165/133, 134.1; 228/283.17; 428/654

[56] References Cited

U.S. PATENT DOCUMENTS

| | | | |
|---|---|---|---|
| 3,809,155 | 5/1974 | Anthony et al. | 165/133 |
| 3,843,333 | 10/1974 | Woods | 428/654 |
| 4,121,750 | 10/1978 | Schoer et al. | 228/263.17 X |
| 4,173,302 | 11/1979 | Schultze et al. | 228/263.17 X |
| 4,214,925 | 7/1980 | Arita et al. | 228/263.17 X |
| 4,560,625 | 12/1985 | Kaifu et al. | 428/654 |
| 4,587,701 | 5/1986 | Koisuka et al. | 29/890.035 |
| 4,716,959 | 1/1988 | Aoki | 165/152 |
| 4,761,267 | 8/1988 | Takeno et al. | 420/529 |
| 4,991,647 | 2/1991 | Kawabe et al. | 165/134.1 |
| 5,054,549 | 10/1991 | Nakaguro | 165/133 |
| 5,072,789 | 12/1991 | Usui et al. | 165/134.1 |

FOREIGN PATENT DOCUMENTS

| | | | |
|---|---|---|---|
| 36341 | 9/1972 | Japan | 165/133 |
| 33154 | 3/1977 | Japan | 165/134.1 |
| 95094 | 7/1980 | Japan | 165/134.1 |
| 227970 | 11/1985 | Japan | 228/263.17 |
| 2159175 | 11/1985 | United Kingdom | 420/534 |

*Primary Examiner*—John Rivell
*Assistant Examiner*—L. R. Leo
*Attorney, Agent, or Firm*—Morgan & Finnegan

[57] ABSTRACT

A tubular element for a heat-exchanger comprises a tubular core composed of a first aluminum alloy comprising up to 0.3 wt % maximum of silicon, up to 0.5 wt % maximum of iron, from 0.50 to 0.70 wt % of copper, from 0.65 to 1.0 wt % of manganese, from 0.1 to 0.30 wt % of magnesium, up to 0.05 wt % maximum of zinc, from 0.08 to 0.10 wt % of titanium, and the balance aluminum and unavoidable impurities; an inner layer of a second aluminum alloy on the tubular core; and an outer brazable layer of a third aluminum alloy on the tubular core. The tubular core and the inner layer may be selected to have a corrosion potential difference of from 170 to 200 mV verses a saturated calomel electrode. The tubular core may have a grain size falling within the range about ASTM 5 to about ASTM 6 and the grains having a morphology which is elongated in the axial direction of the tubular core.

20 Claims, 1 Drawing Sheet

TUBULAR ELEMENT FOR A HEAT EXCHANGER

BACKGROUND OF THE INVENTION

1. Field of the Invention

The present invention relates to a tubular element for use in a heat-exchanger for example for use in a radiator, car-heater, intercooler or the like in an automobile.

2. Description of the Prior Art

Aluminum heat exchangers are known for the above-mentioned uses which comprise tubular elements which allow a heat-exchanging medium to flow therethrough. These heat-exchangers require a high-corrosion resistance and good mechanical strength in order to provide an adequate lifetime which is typically considered to be around 10 years. It is known to employ a controlled atmosphere braze (CAB) furnace process to manufacture such heat-exchangers from the tubular elements of the alloy "AA3003" which is relatively corrosion resistant and the composition of which is specified by the Aluminum Association. The "AA3003" alloy is used for the tube, header and sidewall of the exchangers and modifications to the "AA3003" alloy composition have been made in order to achieve both corrosion resistance and strength. However, the brazing process carried out on "AA3003" tubular elements can cause secondary effects such as silicon diffusion and fin erosion which has limited the performance of such tubular elements in the pressure and thermal cycles and in corrosive tests for production validation.

In addition, the heat-exchange medium which is employed in heat-exchangers is generally water which may include impurities mixed with engine coolants and atmospheric contaminants. These provoke corrosion susceptibility of the heat-exchanger tubular elements during normal use. The tubular elements of known heat-exchangers comprise an inner clad layer which has a sacrificial character, that is a nobler corrosion potential than the core of the tubular element and an outer clad layer, which is a brazing layer, for securing fin members to the tubular elements. The inner clad layer is intended to protect the heat-exchanger tube and other components against corrosion. The core material is also required to exhibit good resistance to silicon penetration by diffusion, the diffusion being dependent upon the brazing time, the brazing temperature and the silicon content in the brazing layer.

U.S. Pat. No. 4,991,647 discloses a heat-exchanger comprising tubular elements made of a first aluminum alloy and fin members of a second aluminum alloy. The first aluminum alloy comprises 0.05 to 1.0 wt % of Mg, 0.2 to 1.2 wt % of Si, 0.2 to 1.5 wt % of Mn, 0.01 to 0.5 wt % of Fe and the balance aluminum. The second aluminum alloy comprises 0.05 to 1.0 wt % of Mg, 0.2 to 1.2 wt % of Si, 0.2 to 1.5 wt % of Mn 0.01 to 0.5 wt % of Fe, at least one of 0.01 to 1.0 wt % of In and 0.1 to 2.0 wt % Zn and the balance aluminum.

SUMMARY OF THE INVENTION

An object of the invention is to provide a tubular element for a heat-exchanger tube, header and sidewall with improved corrosion resistance and lower silicon diffusion susceptibility than known tubular elements.

Another object of the invention is to provide a tubular element for a heat-exchanger, which tubular element has a particular combination of a tubular core and an inner clad layer which has improved corrosion resistance as compared to known tubular elements.

Accordingly, the present invention provides a tubular element for a heat-exchanger comprising:

a tubular core composed of a first aluminum alloy comprising up to 0.3 wt % maximum of silicon, up to 0.5 wt % maximum of iron, from 0.50 to 0.70 wt % of copper, from 0.65 to 1.0 wt % of manganese, from 0.1 to 0.30 wt % of magnesium, up to 0.05 wt % maximum of zinc, from 0.08 to 0.10 wt % of titanium, and the balance aluminum and unavoidable impurities;

an inner layer on the tubular core and composed of a second aluminum alloy comprising up to 0.70 wt % maximum in total of silicon and iron, up to 0.10 wt % maximum of copper, up to 0.10 wt % maximum of manganese, up to 0.10 wt % maximum of magnesium, from 0.80 to 1.3 wt % of zinc, up to 0.05 wt % maximum of titanium and the balance aluminum and unavoidable impurities; and an outer brazable layer on the tubular core and composed of a third aluminum alloy comprising from 6.8 to 8.2 wt % of silicon, up to 0.80 wt % maximum of iron, up to 0.25 wt % maximum of copper up to 0.10 wt % maximum of manganese, up to 0 10 wt % maximum of zinc, up to 0.05 wt % maximum of titanium, and the balance aluminum and unavoidable impurities.

The present invention also provides a tubular element for a heat exchanger, the tubular element comprising:

a tubular core composed of a first aluminum alloy; and an inner layer clad on the tubular core, the inner clad layer being composed of a second aluminum alloy and being adapted, in use, to act as a sacrificial anodic layer for the tubular core, the first and second aluminum alloys being chosen so that the corrosion potential difference between the tubular core and the inner clad layer is in the range from about 170 to about 200 mV versus a saturated calomel electrode.

The present invention further provides a tubular element for a heat exchanger, the tubular element comprising: a tubular core comprised of a first aluminum alloy;

an inner layer on the tubular core and composed of a second aluminum alloy; and an outer layer composed of a third aluminum alloy clad on the tubular core;

the tubular core having a grain size falling within the range about ASTM 5 to about ASTM 6 and the grains having a morphology which is elongated in the axial direction of the tubular core.

BRIEF DESCRIPTION OF THE DRAWINGS

The other objects, features and advantages of the invention will become apparent from the following description which is made referring to the accompanying drawings, in which.

DETAILED DESCRIPTION OF THE PREFERRED EMBODIMENTS

Figure 1:
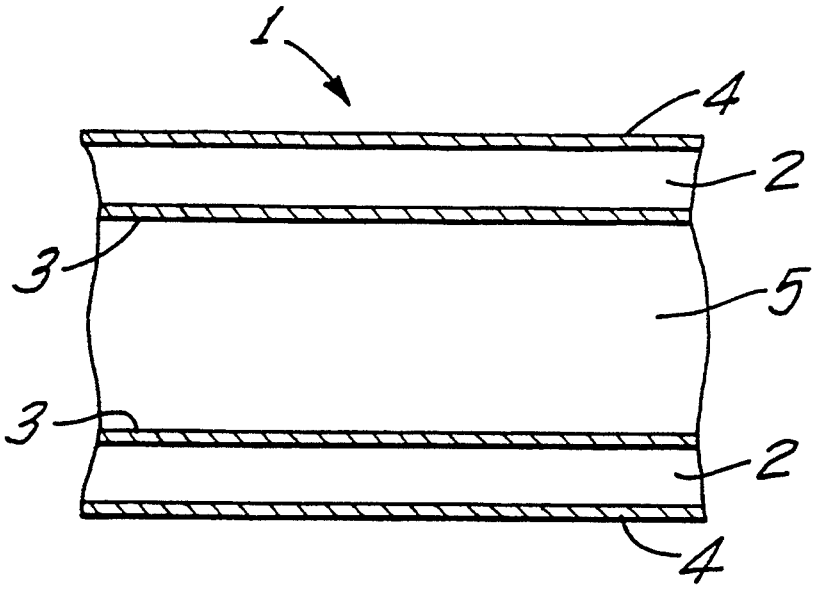
FIG. 1 is a longitudinal cross-sectional view of a tubular element in accordance with an embodiment of the present invention.

Referring to FIG. 1, a tubular element designated generally as 1, in accordance with an embodiment of the present invention, comprises a tubular core 2, an inner clad layer 3 and an outer clad layer 4. The inner clad layer 3, defines a central passage 5 of the tubular element 1 through which, in use, a heat-exchange medium flows. The tubular element 1 may be formed by any appropriate method, such as extrusion or drawing, which is known to the man skilled in the art. Typically, the inner clad layer 3 has a thickness which is around 12% of the total thickness of the tubular element 1 and the outer clad layer 4 has a thickness which is around 9 to 12% of the total thickness of the tubular element 1.

The core 2 of the tubular element 1 of the illustrated embodiment of the present invention is composed of the aluminum alloy "3532" which is available in commerce from the Hoogovens Aluminum Corporation. The inner layer 3, which is a sacrificial anodic layer, is of the known aluminum alloy "AA7072" and outer layer 4, which is a braze clad layer, is of the known aluminum alloy "AA4343". The alloys "AA7072" and "AA4343" are in accordance with the specifications of the Aluminum Association.

Figure 2:
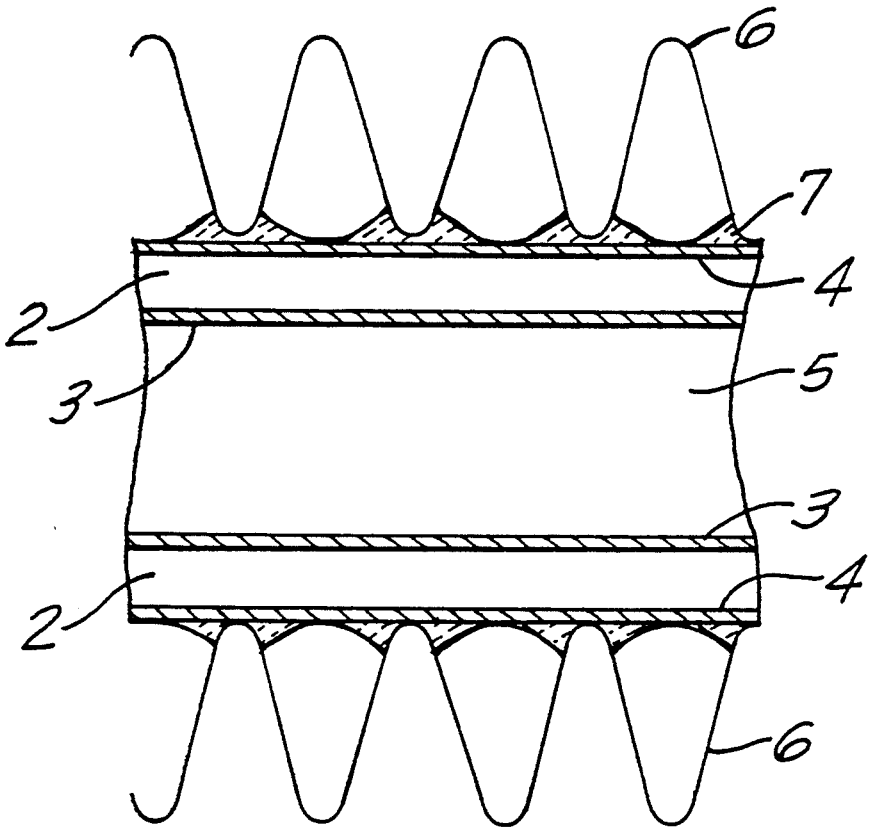
FIG. 2 is a longitudinal cross-sectional view of the tubular element of FIG. 1 after external fin members have been brazed thereto.

Referring to FIG. 2, it will be seen that on brazing fin members 6 to the tubular element 1 by the braze clad layer 4, a diffusion zone 7 is formed between the core 2 and the outer braze clad layer 4. The fin members 6 are typically composed of the aluminum alloy "AA3003" with an addition of 1.5% zinc.

In accordance with the invention, corrosion potential differences between the braze clad layer 4 and the core 2 in the un-brazed condition and the diffusion zone 7 and the core 2 in the post-brazed condition promote galvanic cell corrosion in which the more ignoble part of the galvanic couple is preferentially attacked. The zinc addition to the fin material 6 protects the tubular element 1 against corrosion because the core 2 has a less noble corrosion potential than the fin member 6 and so the fin member 6 would tend to dissolve preferentially in a corrosive medium to which the tubular element may be subjected during its lifetime.

In addition, in accordance with the preferred embodiment of the present invention the combination of (i) the optimization of the corrosion potential difference between the core 2 and the inner clad layer 3 of the tubular element 1 by the selection of specific materials for the core 2 and inner clad layer 3; (ii) the fabrication of a tubular element 1 in which the core 2 has a large grain structure and elongated grain morphology in the crystalline aluminum alloy structure by the control of a selected tube forming process; and (iii) the selection of a specific alloy composition of the core 2, results in a tubular element 1 of improved corrosion resistance to the heat-exchange medium in the central passage 5. However, each of these aspects individually enhances the corrosion resistance of the tubular element to the heat-exchange medium during use.

Concerning feature (i), the core alloy and the inner clad alloy are selected so as to have a corrosion potential difference therebetween of from 170 to 200 mV versus a Saturated Colomel Electrode (S.C.E.). This is higher than in the prior art tubular elements and provides improved corrosion resistance because of the greater sacrificial nature of the inner clad layer. However, higher corrosion potential differences between the core and the inner layer could result in a more rapid removal of the inner clad leaving the core without sacrificial protection. Alternatively, a corrosion potential difference between the core and inner layer which is too low diminishes the cathodic protection of the inner layer and corrosion will depend upon the alloy composition of the core material. Not only are the values of the corrosion potential important but so are the polarization characteristics of the reaction process and the activity of the surface of the alloys involved in the corrosion reaction.

Concerning feature (ii), the alignment of the grains in the aluminum alloy of the core 2 parallel to the length of the tubular element 1 results in a tubular element 1 which exhibits corrosion parallel to the internal surface of the tubular element 1, i.e. along the length of the tubular element 1, as opposed into the depth of the tubular element 1. This is advantageous because such parallel corrosion takes longer to penetrate the tubular element than corrosion in a direction through the tubular element. This elongate grain structure also results in a tubular element 1 of improved mechanical properties over known tubular elements. In accordance with the invention the grain size of the core 2 is preferably from 5 to 6 ASTM which is coarser than a grain size of 4 ASTM which is typically found in the prior art. The coarser grain size, together with the elongated morphology of the grains in the axial direction, provides improved corrosion resistance and increased mechanical strength.

Concerning feature (iii), the alloy composition of alloy "3532" provides improved corrosion resistance because it has a higher (i.e. less negative) corrosion potential difference than known alloys such as "AA3003" and thereby is more readily protected by a sacrificial inner clad layer. In addition, the alloy "3532"has a reduced tendency than, for example "AA3003", for silicon to diffuse thereto in the brazing process. This enchances the corrosion protection of the core by the braze clad layer.

In order to test the corrosion resistance of tubular elements formed in accordance with the invention and to compare that corrosion resistance to the prior art, an internal corrosion test as described in ASTM D2570-85 was performed using a corrosive solution having the composition shown in Table 1. The particular corrosive solution used in this test provides an increased corrosive aggresivity over that described in ASTM D2570-85.

TABLE 1

Chemical composition of corrosive solution employed for internal corrosion test purposes:

| Component | mg/liter | Ion Concentrations |
|---|---|---|
| NaCl | 225.50 | 1636.78 ppm $Cl^-$ |
| $Na_2SO_4$ | 89.00 | 60.17 ppm $SO^=$ |
| $CuCl_2.2H_2O$ | 2.65 | 0.99 ppm $Cu^{+2}$ + 1.1 ppm Cl− |
| $FeCl^=_3.6H_2O$ | 145.00 | 29.97 ppm $Fe^{+3}$ + 57.88 ppm $Cl^-$ |

The results of the test showed significant improvements in the corrosion resistance of tubular elements 1 of the present invention over that of other commercial heat-exchanger tubes measured under similar conditions. In particular, these improvements included a reduction of about 25 to 35 percent in the corrosion susceptibility, and a reduction of about 15 to 25 percent in the silicon diffusion into the core 2 from the braze clad layer 4 and in the fin erosion after the brazing process. Such improvements would be manifested in an increased durability of the heat-exchanger tubular elements in service. The following non-limiting example further illustrates the present invention.

EXAMPLE 1

An example of the materials for the tubular elements 1 will now be described. The composition of the aluminum alloys, expressed by weight percent for the core 2, inner layer 3 and outer layer 4 of the tubular elements 1, are shown in Table 2 below.

TABLE 2

| | ALLOY (component) | | |
|---|---|---|---|
| ELEMENT | AA4343 (Braze Clad) | 3532 (Core) | AA7072 (Inner Clad) |
| Silicon | 6.8–8.2 | .3 Max. | .70 Max. Silicon + |
| Iron | .80 Max. | .5 Max. | Iron |
| Copper | .25 Max. | .50–.70 | .10 Max. |
| Manganese | .10 Max. | .65–1.0 | .10 Max. |
| Magnesium | — | .10–.30 | .10 Max. |
| Zinc | .10 Max. | .05 Max. | .80–1.3 |
| Titanium | .05 Max. | .08–.10 | — |
| Impurities | | | |
| (each) | .05 Max. | .05 Max. | .05 Max. |
| (Total) | .15 Max. | .15 Max. | .15 Max. |
| Aluminum | Remainder | Remainder | Remainder |

The corrosion potentials of the tubular element 1 in accordance with the present invention and that of a known tubular element used in heat-exchangers are shown in Table 3. The corrosion potentials were determined according to ASTM G69 specification and are given in millivolts versus a Saturated Calomel Electrode (S,C.E.).

TABLE 3

| PRESENT INVENTION | CORROSION POTENTIAL mV/S.C.E. | KNOWN TUBULAR ELEMENT | CORROSION POTENTIAL mV/S.C.E. |
|---|---|---|---|
| Inner layer (AA7072) | −870 | Inner layer (AA7072) | −870 |
| Core (3532) | −685 | Core (AA3003) | −725 |
| Diffusion Zone | −720 | Diffusion Zone | −720 |
| Outer Braze Clad Layer (AA4343) | −700 | Outer Braze Clad Layer (AA4343 or AA4045) | −700 or −760 |

It will be seen that the corrosion potential difference between the inner layer 3 and core 2 for the tubular element 1 of the present invention is about 185 mV/S.C.E. as compared to about 145 mV/S.C.E. for a known tubular element comprising a core of alloy of "AA3003" and an inner layer of "AA7072". Thus, the sacrificial character of the "AA7072" inner layer 3 of the tubular element 1 of the present invention is accentuated as compared to that of the known tubular element. This means that the combination of a core alloy and an inner clad alloy having a higher corrosion potential difference than of the prior art provides improved corrosion resistance.

In accordance with another preferred embodiment of the invention, the inner clad layer can be composed of an aluminum alloy other than "AA7072" but which exhibits similar electrochemical characteristics to that alloy.

It will now be apparent in view of the above-mentioned test that the tubular element of the present invention is of a higher strength and exhibits an increased corrosion resistance even after brazing fin members to the tubular element than the known tubular elements. The present invention provides a new material combination for heat exchange tubes, headers and side walls with improved corrosion resistance and lower silicon diffusion susceptibility than normal commercial aluminum alloys, thus increasing heat exchanger durability.

What is claimed is:

1. A tubular element for a heat-exchanger comprising:

a tubular core composed of a first aluminum alloy comprising up to 0.3 wt % maximum of silicon, up to 0.5 wt % maximum of iron, from 0.50 to 0.70 wt % of copper, from 0.65 to 1.0 wt % of manganese, from 0.1 to 0.30 wt % of magnesium, up to 0.05 wt % maximum of zinc, from 0.08 to 0.10 wt % of titanium, and the balance aluminum and unavoidable impurities;

an inner layer on the tubular core and composed of a second aluminum alloy comprising up to 0.70 wt % maximum in total of silicon and iron, up to 0.10 wt % maximum of copper, up to 0.10 wt % maximum of manganese, up to 0.10 wt % maximum of magnesium, from 0.80 to 1.3 wt % of zinc, up to 0.05 wt % maximum of titanium and the balance aluminum and unavoidable impurities; and an outer brazable layer on the tubular core and composed of a third aluminum alloy comprising from 6.8 to 8.2 wt % of silicon, up to 0.80 wt % maximum of iron, up to 0.25 wt % maximum of copper, up to 0.10 wt % maximum of manganese, up to 0.10 wt % maximum of zinc, up to 0.05 wt % maximum of titanium, and the balance aluminum and unavoidable impurities.

2. A tubular element according to claim 1, wherein the first and second aluminum alloys are selected so that the corrosion potential difference between the tubular core and the inner clad layer is in the range from about 170 to about 200 mV versus a saturated calomel electrode.

3. A tubular element according to claim 1, wherein the first and second aluminum alloys are selected so that the corrosion potential difference between the tubular core and the inner clad layer is about 185 mV versus a saturated calomel electrode.

4. A tubular element according to claim 1, wherein the tubular core has a grain size falling within the range about ASTM 5 to about ASTM 6 and the grains have a morphology which is elongated in the axial direction of the tubular core.

5. A tubular element according to claim 1, wherein the thickness of the inner clad layer is about 12 percent of the total wall thickness of the tubular element and the thickness of the outer clad layer is from 9 to 12 percent of the total wall thickness of the tubular element.

6. A tubular element according to claim 1, further comprising external fin members brazed thereto, said fin members being composed of the aluminum alloy "AA3003" which additionally includes 1.5 wt % zinc.

7. A tubular element for a heat exchanger, the tubular element comprising:

a tubular core composed of a first aluminum alloy; and an inner layer clad on the tubular core, the inner clad layer being composed of a second aluminum alloy and being adapted, in use, to act as a sacrificial anodic layer for the tubular core, the first and second aluminum alloys being chosen so that the corrosion potential difference between the tubular core and the inner clad layer is in the range from about 170 to about 200 mV versus a saturated calomel electrode.

8. A tubular element according to claim 7, wherein the first and second aluminum alloys are chosen so that the corrosion potential difference between the tubular core and the inner clad layer is about 185 mV versus a saturated calomel electrode.

9. A tubular element according to claim 7, wherein the first aluminum alloy comprises up to 0.3 wt % maximum of silicon, up to 0.5 wt % maximum of iron, from 0.50 to 0.70 wt % of copper, from 0.65 to 1.0 wt % of manganese, from 0.1 to 0.30 wt % of magnesium, up to 0.05 wt % maximum of zinc, from 0.08 to 0.10 wt % titanium, and the balance aluminum and unavoidable impurities.

10. A tubular element according to claim 7, wherein the second aluminium alloy comprises up to 0.70 wt % maximum in total of silicon and iron, up to 0.10 wt % maximum of copper, up to 0.10 wt % maximum of manganese, up to 0.10 wt % maximum of magnesium, from 0.80 to 1.3 wt % of zinc, up to 0.05 wt % maximum of titanium and the balance aluminium and unavoidable impurities.

11. A tubular element according to claim 7, wherein the tubular core has a grain size falling within the range about ASTM 5 to about ASTM 6 and the grains have a morphology which is elongated in the axial direction of the tubular core.

12. A tubular element according to claim 7, further comprising an outer brazable layer clad on the tubular core and composed of a third aluminum alloy comprising from 6.8 to 8.2 wt % of silicon, up to 0.80 wt % maximum of iron, up to 0.25 wt % maximum of copper, up to 0.10 wt % maximum of manganese, up to 0.10 wt % maximum of zinc, up to 0.05 wt % maximum of titanium, and the balance aluminum and unavoidable impurities.

13. A tubular element according to claim 12, wherein the thickness of the inner clad layer is about 12 percent of the total wall thickness of the tubular element and the thickness of the outer brazable layer is from 9 to 12 percent of the total wall thickness of the tubular element.

14. A tubular element for a heat exchanger, the tubular element comprising:

a tubular core comprised of a first aluminum alloy;

an inner layer on the tubular core and composed of a second aluminum alloy; and an outer layer composed of a third aluminum alloy clad on the tubular core;

the tubular core having a grain size falling within the range about ASTM 5 to about ASTM 6 and the grains having a morphology which is elongated in the axial direction of the tubular core.

15. A tubular element according to claim 14, wherein the first aluminum alloy comprises up to 0.3 wt % maximum of silicon, up to 0.5 wt % maximum of iron, from 0.50 to 0.70 wt % of copper, from 0.65 to 1.0 wt % of manganese, from 0.1 to 0.30 wt % of magnesium, up to 0.05 wt % maximum of zinc, from 0.08 to 0.10 wt % of titanium, and the balance aluminum and unavoidable impurities.

16. A tubular element according to claim 14, wherein the second aluminum alloy comprises up to 0.70 wt % maximum in total of silicon and iron, up to 0.10 wt % maximum of copper, up to 0.10 wt % maximum of manganese, up to 0.10 wt % maximum of magnesium, from 0.80 to 1.3 wt % of zinc, up to 0.05 wt % maximum of titanium, and the balance aluminum and unavoidable impurities.

17. A tubular element according to claim 14, wherein the third aluminum alloy comprises from 6.8 to 8.2 wt % of silicon, up to 0.80 wt % maximum of iron, up to 0.25 wt % maximum of copper, up to 0.10 wt % maximum of manganese, up to 0.10 wt % maximum of zinc, up to 0.05 wt % maximum of titanium, and the balance aluminum and unavoidable impurities.

18. A tubular element according to claim 14, wherein the first and second aluminum alloys are selected so that the corrosion potential difference between the tubular core and the inner clad layer is in the range from about 170 to about 200 mV versus a saturated calomel electrode.

19. A tubular element according to claim 18, wherein the first and second aluminum alloys are selected so that the corrosion potential difference between the tubular core and the inner clad layer is about 185 mV versus a saturated calomel electrode.

20. A tubular element according to claim 14, wherein the thickness of the inner clad layer is about 12 percent of the total wall thickness of the tubular element and the thickness of the outer clad layer is from 9 to 12 percent of the total wall thickness of the tubular element.

* * * * *